US006043703A

United States Patent [19]

Bavol

[11] Patent Number: 6,043,703

[45] Date of Patent: Mar. 28, 2000

[54] LOW POWER ACTIVE INPUT CIRCUIT

[75] Inventor: Ronald A. Bavol, Willowick, Ohio

[73] Assignee: Allen-Bradley Company, LLC, Milwaukee, Wis.

[21] Appl. No.: 08/902,708

[22] Filed: Jul. 30, 1997

[51] Int. Cl.[7] ..... G05F 1/00

[52] U.S. Cl. ..... 327/538; 327/514

[58] Field of Search ..... 323/311, 312, 323/313; 327/514, 530, 534, 535, 537, 538, 540, 541, 543, 545, 546

[56] References Cited

U.S. PATENT DOCUMENTS

| | | | |
|---|---|---|---|
| 3,700,934 | 10/1972 | Swain | 307/310 |
| 3,968,472 | 7/1976 | Taylor | 327/502 |
| 4,025,850 | 5/1977 | Spiteri | 324/133 |
| 4,112,346 | 9/1978 | Tokunaga et al. | 323/4 |
| 4,347,475 | 8/1982 | Ullin | 323/303 |
| 4,420,700 | 12/1983 | Fay et al. | 307/571 |
| 5,539,352 | 7/1996 | DuPuy | 327/514 |

*Primary Examiner*—Jeffrey Zweizig

*Attorney, Agent, or Firm*—John M. Miller; John J. Horn; William R. Walbrun

[57] ABSTRACT

An active input circuit module includes a plurality of active input circuits disposed on a circuit board each circuit having an input and a return. Each active input circuit further has a constant current source having a current source input and a constant current output coupled through a current limiting resistor to an opto-coupler input and the return. A shunt resistor is coupled in parallel with the opto-coupler input.

8 Claims, 6 Drawing Sheets

LOW POWER ACTIVE INPUT CIRCUIT

BACKGROUND OF THE INVENTION

The present invention relates generally to input circuits that are connected to remote input sensors or other input devices. More particularly, the present invention relates to an active circuit that limits its power consumption and consequently occupies less physical space.

Input circuits provide a physical and electrical connection between an external sensor or other input device and an industrial controller or other monitoring apparatus. Typically, input circuits are ganged together on a circuit board which is part of an I/O module, each circuit board comprising a plurality of electrically isolated input circuits. This facilitates easy and cheap construction as well as a common location for making electrical connections for proximal sensors or other input devices. Typically, the output of the input circuits are coupled to application specific integrated circuits (ASICs) which convert and transmit input data over a network link. Alternately, the input circuits may be directly coupled to an industrial controller or other monitoring apparatus which monitors the input data.

FIG. 1 illustrates an individual prior art passive input circuit 10. A sensor or other input is connected across input terminal 12 and return terminal 14. Between the input terminal 10 and the return 12 is a series combination of a current limiting resistor 16 and an LED side of an opto-coupler 22. Also included are a shunt resistor 18 and shunt capacitor 20 in parallel with the LED side of opto-coupler 22 which primarily serve to reduce the effect of spurious noise and voltage inputs significantly below the turn-on threshold of the input circuit 10. The output side of the opto-coupler 22 provides an electrically isolated input signal which is coupled to the ASIC. A diode 32 may also be included to block reverse voltage.

In many industrial automation applications the input voltage applied between terminals 12 and 14 may range between approximately 0; and 31.2 volts. Generally, a low or "off" state is represented by an input voltage between 0 and 10 volts. Conversely, a high or "on" state is represented by an input voltage between 10 and 31.2 volts. Since the opto-coupler must have enough current to turn on at the lower range of turn-on input voltage (i.e. 10 volts) the current limiting resistor cannot be too large. However, to satisfy this condition the input circuit draws a relatively large current at the upper end of the permissible input voltage range (i.e. 31.2 volts).

FIG. 3 (Line B) illustrates a relatively linear relationship between the input voltage and current of the passive input circuit. As shown, the current through the circuit 10 increases linearly when the input voltage is below the turn-on threshold of the circuit. Similarly, once the circuit is "on" the current increases linearly with the input voltage throughout the permissible input range and consequently the current limiting resistor 16 consumes more power as the input voltage increases. In particular, when the maximum input voltage of 31.2 volts is applied to terminal 12, the voltage across the current limiting resistor 16 is approximately 29.3 volts, given the opto-coupler LED turns on between 0.8 and 1.2 volts, and the current limiting resistor 16 is consuming nearly 0.5 watts of power. As a result, current limiting resistor 16 must have a relatively high power rating as compared with the other circuit components. Moreover, the size and heat dissipation of resistor 16 are increased. Also, when many input circuits are ganged together on a single circuit board the heat dissapation rating of the board often requires the usage of ceramic or iron-clad type circuit boards which is more expensive.

Although passive input circuits are relatively cheap they consume an appreciable amount of power, generate a significant amount of heat, and consume a significant amount of circuit board real estate due to the large current limiting resistor 16. Thus, there is a need for an input circuit which consumes less power and less circuit board real estate but is still relatively cheap to construct. In particular, there is a need for an active input circuit that clamps the input current within a nominal range when the input voltage exceeds the turn-on threshold to yield a circuit which consumes less power and circuit board real estate. Moreover, there is a present need for an active input circuit which consumes less power thereby enabling the usage of less expensive circuit boards when a plurality of input circuits are ganged together.

SUMMARY OF THE INVENTION

The present invention features an active input circuit which generally comprises a constant current source, a current limiting resistor and an opto-coupler. Additionally, the active input circuit may include a surge diode and a noise limiting capacitor in parallel with the input LED side of the opto-coupler.

Thus, in accordance with one aspect of the invention, an active input circuit includes an input and a constant current source having a constant current source input and a constant current output, the input coupled to the constant current source input. A current limiting resistor is coupled to the constant current source output and an opto-coupler input to a return. A shunt resistor is coupled in parallel with the opto-coupler input. The constant current source limits an input current to a nominal range when an input circuit turn-on voltage is exceeded.

Thus, in accordance with another aspect of the present invention, an active input circuit module includes a plurality of active input circuits disposed on a circuit board, each circuit having an input and a return. Each active input circuit further has a constant current source comprising a current source input and a constant current output coupled through a current limiting resistor to an opto-coupler input to a return. A shunt resistor is coupled in parallel with the opto-coupler input. Each constant current source limiting an input current to a nominal range when an input circuit turn-on voltage circuit is exceeded.

Thus, in accordance with yet another aspect of the present invention, a method for processing an input signal in an input circuit includes receiving the input signal having an input voltage and linearly conducting an input current when the input voltage is below a predetermined turn-on thresh old. When the input voltage is above the predetermined threshold the method includes clamping the input current within a nominal range and conducting at least a portion of the input current through an opto-coupler input.

It is therefore an object of the present invention to provide an active input circuit which consumes less power than prior art passive type input circuits.

It is a further object of the present invention to provide an active input circuit which consumes less circuit board real estate than prior art passive type input circuits.

It is yet another object of the present invention to provide an active input circuit that has a high noise immunity.

It is still another object of the present invention to provide an active input circuit which when ganged with other active input circuits on a single circuit board does not require the usage of ceramic or iron-clad circuit board materials or other special heat dissipation techniques.

It is yet still another aspect of the present invention to provide an active input circuit having a constant current source comprising a single packaged device.

BRIEF DESCRIPTION OF THE DRAWINGS

The present invention will become more fully understood from the following detailed description, taken in conjunction with the accompanying drawings, wherein like reference numerals refer to like parts, in which.

DESCRIPTION OF THE PREFERRED EMBODIMENTS

Figure 1:
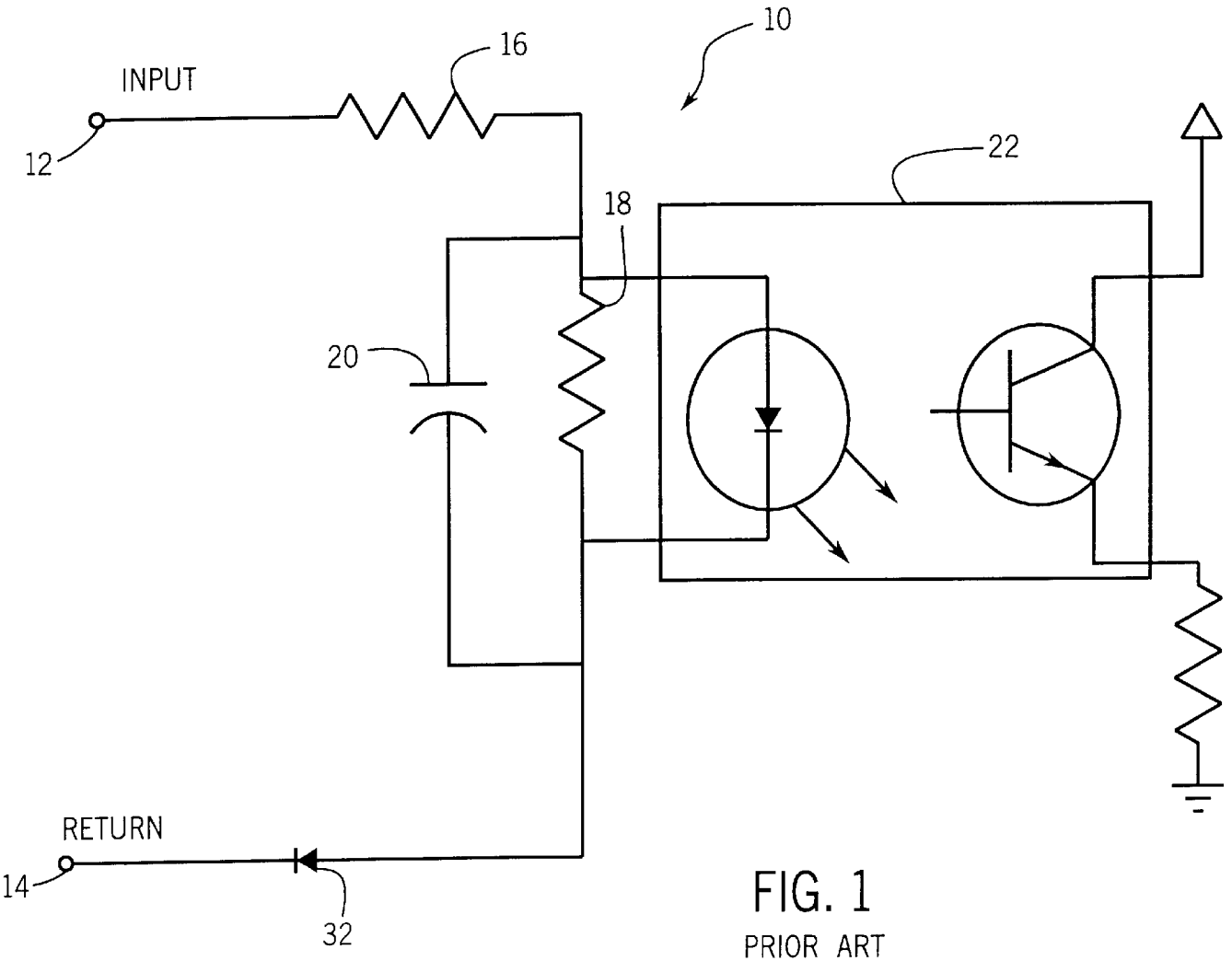
FIG. 1 PRIOR ART
FIG. 1 is a schematic representation of a prior art passive input circuit.
Figure 2:
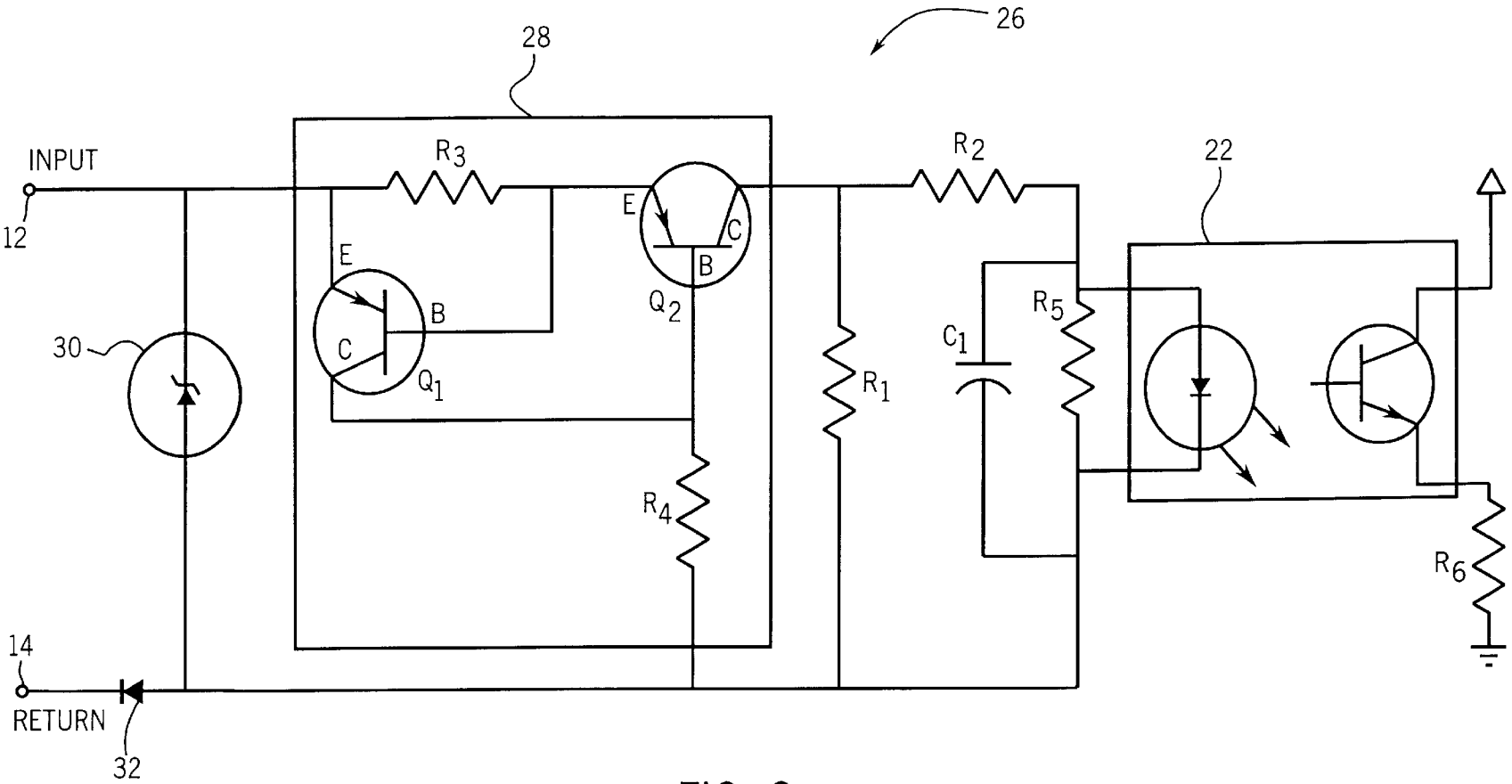
FIG. 2 is a schematic representation of an active input circuit in accordance with a first preferred embodiment of the present invention.

Turning now to the drawings and referring first to FIG. 2, an active input circuit 26, such as for use in an I/O module or other input device, is illustrated and generally includes an input 12, a return 14, a constant current source 28, a current limiting resistor $R_2$ and an opto-coupler 22. Additionally, the active input circuit 26 may include a surge zener diode 30 between the input 12 and return 14 and a noise limiting capacitor $C_1$ and shunt resistor $R_5$ in parallel with the input LED side of the opto-coupler 22. A second current limiting resistor $R_1$ may also be included but is not required. Similarly, a diode 32 may be included to block reverse voltages.

In the first embodiment shown in FIG. 2 the constant current source 28 comprises two PNP transistors $Q_1$ and $Q_2$ and two resistors $R_3$ and $R_4$. In combination, the constant current source 28, the current limiting resistor $R_2$ and opto-coupler 22 make up the basic active input circuit 26. The component values for the active input circuit 20 are shown in Table 1 below:

TABLE 1

Active Input Circuit Component Values

| Component | Value |
|---|---|
| $D_{zener}$ | 47 Volts (Breakdown Voltage) |
| $R_1$ | 3.83 kΩ |
| $R_2$ | 4.64 kΩ |
| $R_3$ | 147 Ω |
| $R_4$ | 46.4 kΩ |
| $R_5$ | 1.0 kΩ |
| $R_6$ | 6.8 kΩ |
| $C_1$ | 0.1 μF |
| $Q_1$ | PNP BJT |
| | 100 hfe |
| $Q_2$ | PNP BJT |
| | 100 hfe |
| Opto-Coupler | 1.2 Volts (Turn On) |

Resistor $R_3$ determines when $Q_1$ begins to turn on and hence sets the maximum current that is output from the constant current source 28. Resistor $R_4$ determines the biasing current output and hence how quickly $Q_2$ begins to limit the current that is output from the constant current source once $Q_1$ begins conducting. The surge diode 30 serves primarily to protect the constant current source 28 from high power transients such as lightening strikes and the like which may otherwise damage the transistors.

Referring again to FIG. 2 the operation of the active input circuit 26 can best be described in three operating modes. In the first operating mode, when the input voltage is between 0 and 5 volts, $Q_1$ is off. Depending of the level of the input voltage $Q_2$ may be either off, in its active region or saturated. When the input voltage is sufficient to forward bias the $V_{eb}$ junction of $Q_2$, the current through the input circuit is primarily conducted through the series combination of $R_3$, $Q_2$, $R_1$, and the parallel combination of $R_2$ and the shunt resistor $R_5$. The shunt resistor, $R_5$ primarily serves to prevent the input LED of opto-coupler 22 from turning on when the input voltage is below 5 volts. Similarly, the shunt capacitor $C_1$ provides a low impedance path for noise which may otherwise turn on the input LED of opto-coupler 22.

In a second operating mode, when the input voltage is between 5 and 10 volts, the voltage across $R_3$ has reached approximately 0.7 volts. As a result, the $V_{eb}$ junction of $Q_1$ is sufficiently forward biased to place $Q_1$ in its active operating region. With $Q_1$ in the active region, the voltage across $R_4$ increases as the biasing current output $I_c$ ($Q_1$) increases. As the input voltage increases between 5 and 10 volts the voltage across $R_4$ begins to counteract the forward biasing voltage $V_{eb}$ of $Q_2$ and begins to bring $Q_2$ out of saturation into its active region.

In a third operating mode, when the input voltage is between 10 and 31.2 volts, the voltage across $R_3$ remains at 0.7 volts and $Q_1$ traverses through its active region and may go into saturation. Consequently, $I_c$ of $Q_1$ increases as does the voltage across $R_4$ which in turn decreases the $I_c$ of $Q_2$. Thus, over a large range of input voltages, the $I_c$ of $Q_2$ increases only minimally as compared with a passive input circuit.

Figure 3:
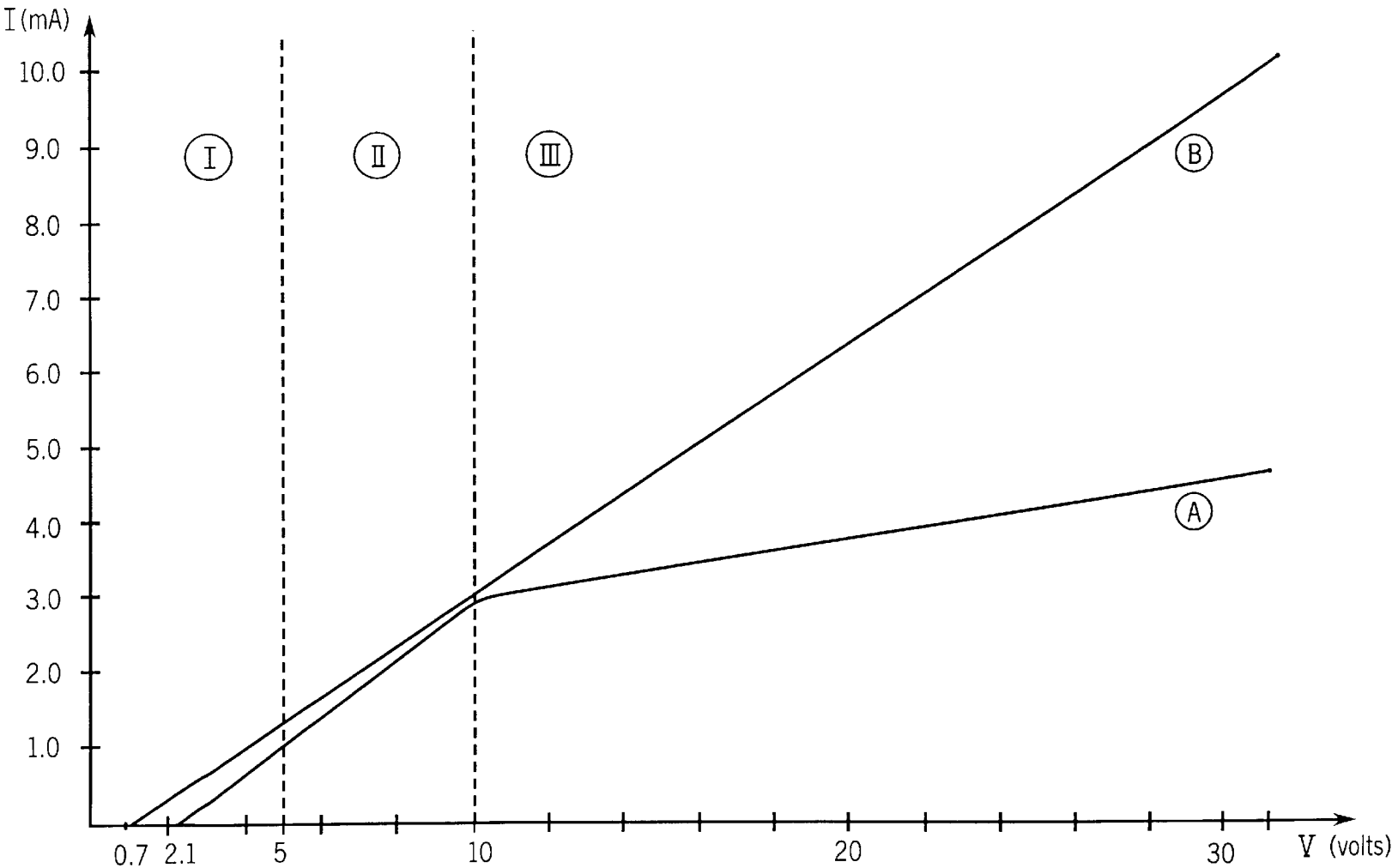
FIG. 3 is an Input Voltage vs. Input Current graph for the circuits shown in FIGS. 1 and 2.

FIG. 3 illustrates the input Voltage vs. Current of the active input circuit 26 of the present invention (labeled "A") and the prior art passive input circuit 10 (labeled "B"). As shown, in region I the input current increases linearly with input voltage. Between 5 and 10 volts, in region II, the current increases but not as linearly as in region I. In region III, between 10 and 31.2 volts, the input current is very non-linear, only increasing nominally within the region. Most importantly, in region III, the passive input circuit 10 which has a linear voltage vs. current relationship draws nearly 10 mA of current at maximum voltage (approx. 31.2 volts) whereas the active input circuit 28 draws only approximately 4.5 mA.

Figure 4:
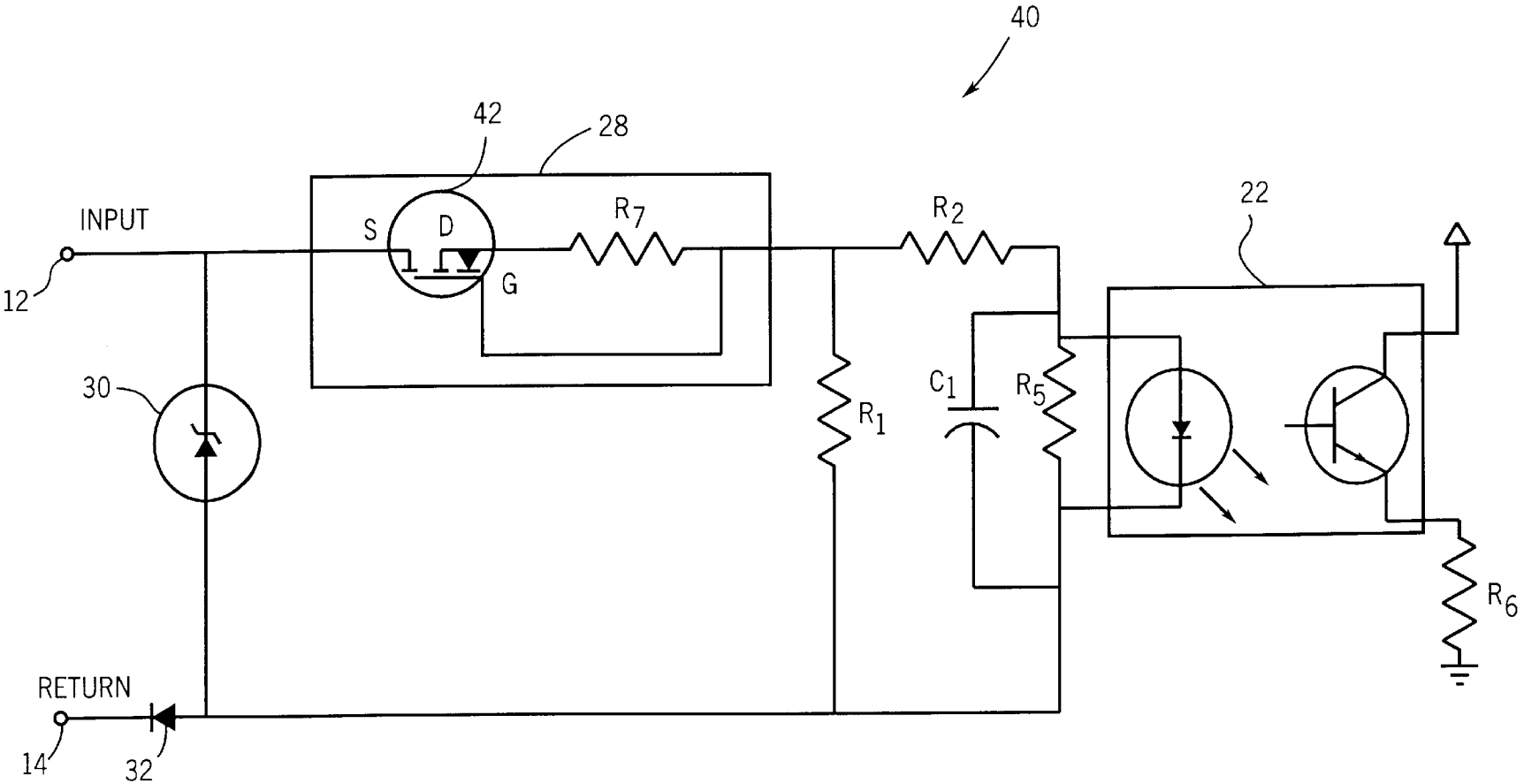
FIG. 4 is a schematic representation of the active input circuit shown in accordance with a second preferred embodiment of the present invention.

FIG. 4 illustrates a second embodiment of the present invention. Generally, active input circuit 40 is similar to active input circuit 26 except a depletion mode FET is used to provide the constant current source 28. Preferably, the FET is a N-channel type (depletion mode) with a pinch off voltage $V_p$ of 4 v and $R_7$ is 861.2 ohms. In operation, as the input voltage increases, the voltage $V_{gs}$ increases and the FET conducts. As the current $I_d$ rises the voltage across $R_6$ increases. Consequently, $V_{gs}$ increases and the FET begins to slowly pinch off the current $I_d$ thereby limiting the current and providing a relatively constant current source when the input voltage is above 10 volts. Importantly, since the current is limited, the active input circuit 40 consumes less power as compared with the prior art passive input circuit 10.

Figure 5:
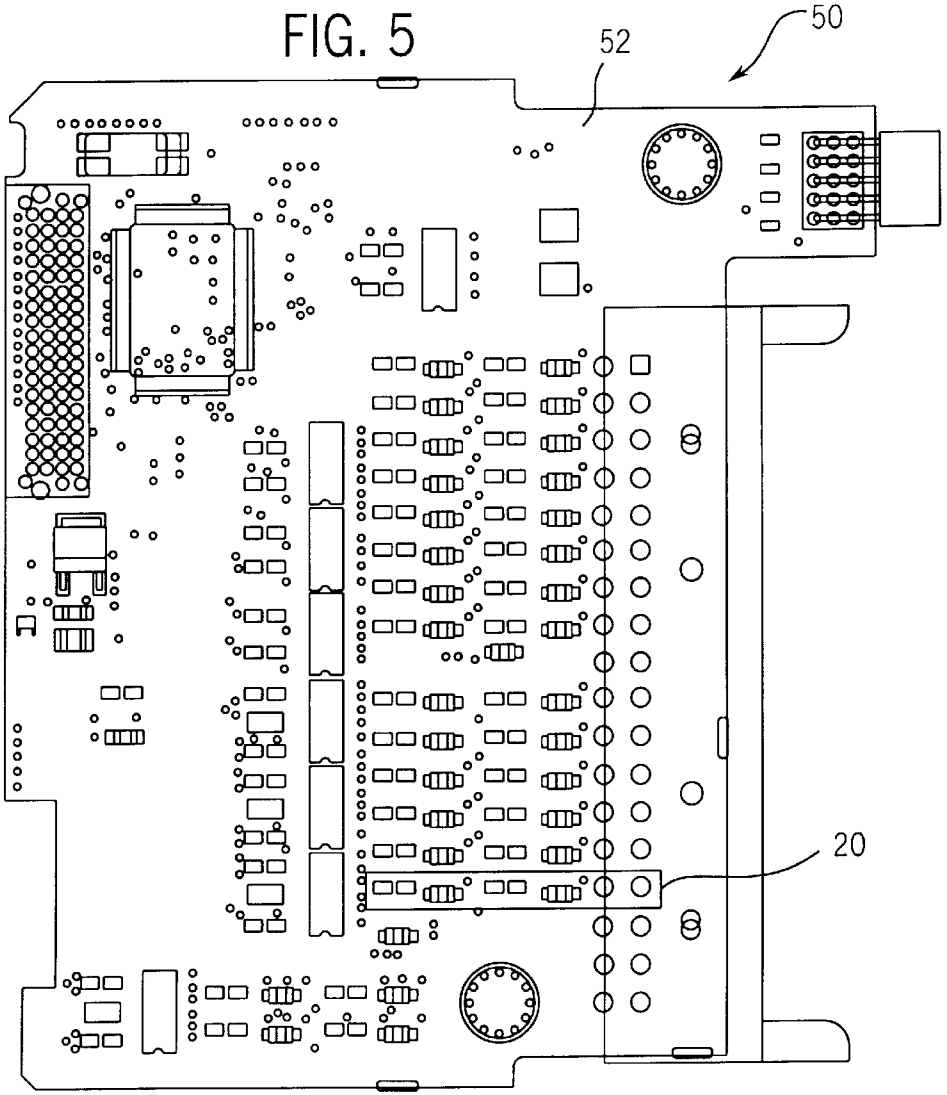
FIG. 5 is a top side plan view of an active input circuit module board in accordance with the preferred embodiments of the present invention.

FIG. 5 illustrates an input module board 50 having a plurality of active input circuits 26. Because of the reduction in size of the current limiting resistor (shown in FIG. 6), each active input circuit 26 takes up less circuit board real estate as compared with the passive input circuit 10. To further conserve circuit board real estate $Q_1$, $Q_2$, $R_3$ and $R_4$ may be combined into a single package with three leads wherein the resistors $R_3$ and $R_4$ are laser trimmed in the silicon substrate.

Figure 6:
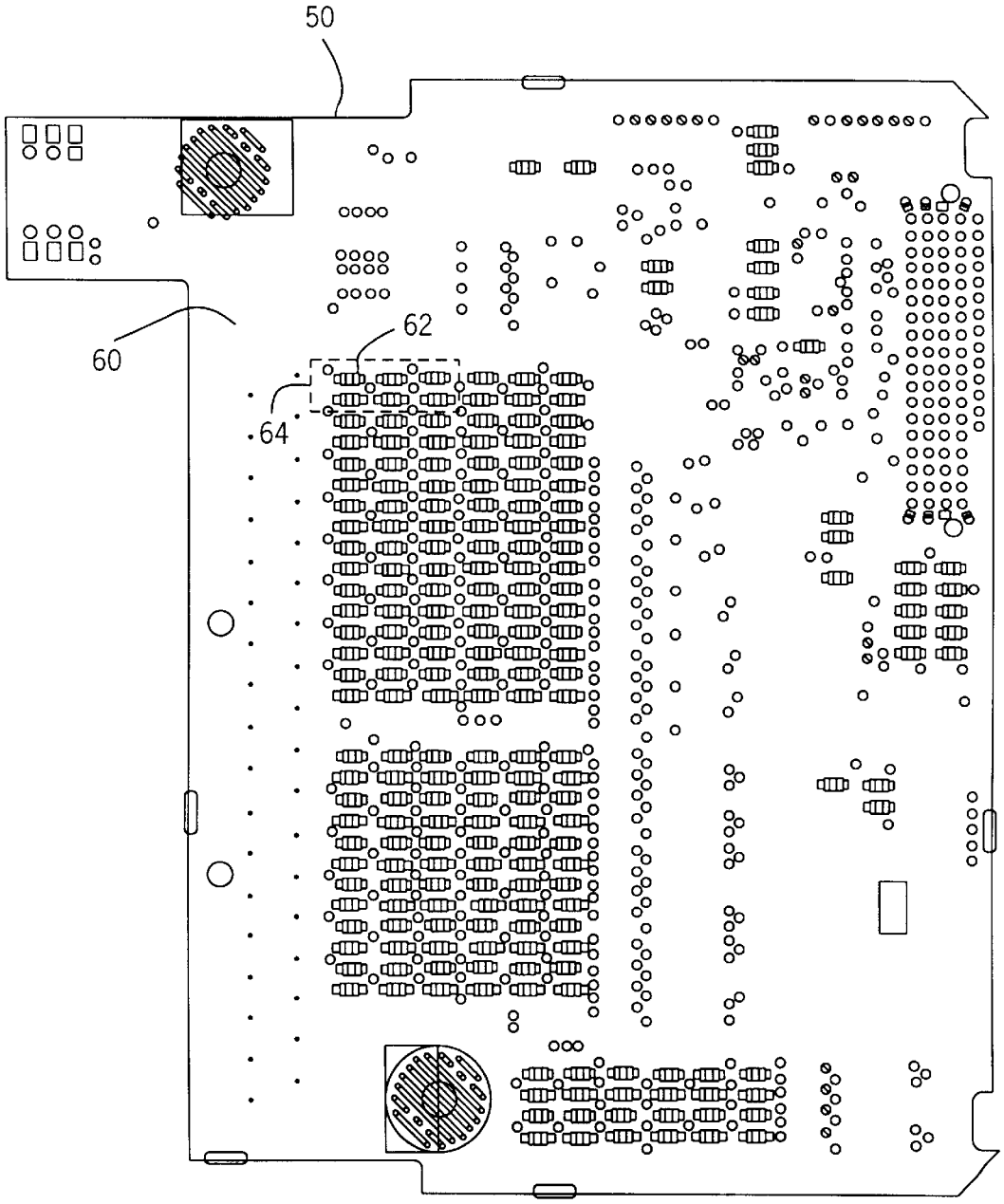
FIG. 6 is a bottom side plan view of an active input circuit module board in accordance with the preferred embodiment of the present invention.

FIG. 6 illustrates the bottom side 60 of input module board 50. The current limiting resistor 62 and the other passive input components generally shown as 64 are mounted proximal for each channel.

While the embodiments illustrated in the FIGURES and described above are presently preferred, it should be understood that these embodiments are offered by way of example only. The invention is not intended to be limited to any particular embodiment, but is intended to extend to various modifications that nevertheless fall within the scope of the appended claims. For example, while the active input circuits 26 and 40 described above include PNP transistors or depletion mode FET's, the invention may include any arrangement of active semiconductor devices which collectively limit the maximum current through the input circuit.

I claim:

1. An active input circuit comprising:

an input;

an active current source comprising a current source input and a current source output, the input coupled to the current source input;

a current limiting resistor coupled to the current source output;

a return;

an opto-coupler input coupled between the current limiting resistor and the return;

a shunt resistor coupled in parallel with the opto-coupler input; and a second current limiting resistor coupled between the active current source output and the return;

wherein the active current source limits an input current to a nominal range when the active input circuit receives an input voltage above a pre-determined threshold.

2. An active input circuit comprising:

an input;

a return;

an active current source comprising a current source input and a current source output, the input coupled to the current source input;

a first transistor having a first emitter, a first collector and a first base, the first emitter coupled to the input;

a first resistor coupled between the first emitter and the first base;

a second transistor having a second emitter, a second collector and a second base, the first base coupled to the second emitter, the first collector coupled to the second base, the second collector coupled to the current source output;

a second resistor coupled between the second base and the return a current limiting resistor coupled to the current source output;

an onto-coupler input coupled between the current limiting resistor and the return; and a shunt resistor coupled in parallel with the opto-coupler input;

wherein the active current source limits an input current to a nominal range when the active input circuit receives an input voltage above a pre-determined threshold.

3. The active input circuit as set forth in claim 2 wherein the first transistor, second transistor, first resistor and second resistor are incorporated within a single package.

4. An active input circuit comprising:

an input;

a first transistor having a first emitter, a first collector and a first base, the first emitter coupled to the input;

a clamping set point resistor coupled between the first emitter and the first base;

a second transistor having a second emitter, a second collector and a second base, the first base coupled to the second emitter, the first collector coupled to the second base;

a return;

a biasing current resistor coupled between the second base and the return;

an opto-coupler;

a current limiting resistor coupled between the second collector and the opto-coupler; and a shunt resistor coupled in parallel with the opto coupler; wherein when the first transistor enters its active region the second transistor begins to clamp a current through the current limiting resistor within a nominal range.

5. The active input circuit as set forth in claim 4 further comprising:

a shunt capacitor coupled in parallel with the shunt resistor.

6. The active input circuit as set forth in claim 4 further comprising:

a surge diode coupled between the input and the return.

7. The active input circuit as set forth in claim 6 further comprising:

a second current limiting resistor coupled between the second collector and the return.

8. The active input circuit as set forth in claim 4 wherein the first transistor, second transistor, clamping set point resistor and resistor are incorporated within a single package.

* * * * *